United States Patent [19]

Germann

[11] 4,441,423

[45] Apr. 10, 1984

[54] COLLECT-PRINTING UNIT FOR SECURITY PRINTING FOR USE IN A ROTARY PRINTING PRESS

[75] Inventor: Albrecht J. Germann, Wurzburg, Fed. Rep. of Germany

[73] Assignee: Koenig & Bauer Aktiengesellschaft, Wurzburg, Fed. Rep. of Germany

[21] Appl. No.: 355,392

[22] Filed: Mar. 8, 1982

[30] Foreign Application Priority Data

Mar. 14, 1981 [DE] Fed. Rep. of Germany ..... 3109964

[51] Int. Cl.[3] ..... B41F 5/16

[52] U.S. Cl. ..... 101/175; 101/177; 101/211

[58] Field of Search ..... 101/136, 137, 175, 177, 101/206–209

[56] References Cited

U.S. PATENT DOCUMENTS

| | | | |
|---|---|---|---|
| 1,052,473 | 2/1913 | Firm | 101/175 X |
| 1,883,227 | 10/1932 | Wood | 101/176 |
| 2,051,135 | 8/1936 | Donohue | 101/207 X |
| 3,390,631 | 7/1968 | Koszul | 101/155 |
| 3,426,679 | 2/1969 | Rhines | 101/175 |
| 3,448,686 | 6/1969 | Bohman | 101/349 |
| 3,902,415 | 9/1975 | Fischer | 101/175 X |

FOREIGN PATENT DOCUMENTS

| | | | |
|---|---|---|---|
| 888247 | 7/1953 | Fed. Rep. of Germany | 101/137 |
| 489839 | 8/1938 | United Kingdom | 101/211 |
| 803546 | 10/1958 | United Kingdom | 101/175 |

*Primary Examiner*—Edgar S. Burr
*Assistant Examiner*—John A. Weresh
*Attorney, Agent, or Firm*—Jones, Tullar & Cooper

[57] ABSTRACT

A collect-printing unit for security printing in dry-offset printing for use in a rotary printing press, provided with a blanket cylinder, to which a plurality of hard cut-out inking rollers are coordinated is disclosed. To this blanket cylinder, two ink transfer cylinders and one forme cylinder, on whose periphery several letterpress formes are fixed, are coordinated. Furthermore, one blanket cylinder is coordinated to the forme cylinder, this blanket cylinder receiving the multi-color motif from the forme cylinder and transferring it onto the support to be printed. A counter-pressure cylinder cooperates with this blanket cylinder. A sheet-shaped or web-shaped support to be printed, is interposed between the blanket cylinder and the counter-pressure cylinder, and is printed in collect-printing.

12 Claims, 1 Drawing Figure

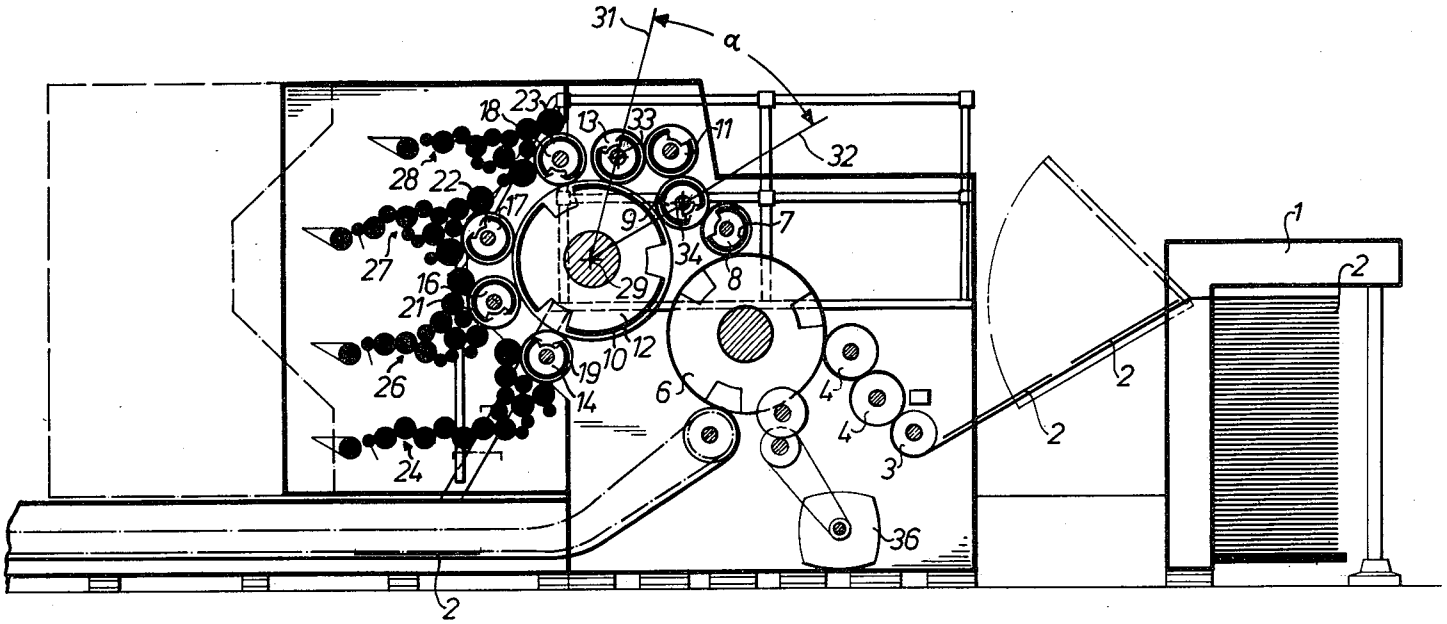
1
2
2
2
2
3
4
4
6
7
8
9
10
11
12
13
14
16
17
18
19
21
22
23
24
26
27
28
29
31
32
33
34
36
α

COLLECT-PRINTING UNIT FOR SECURITY PRINTING FOR USE IN A ROTARY PRINTING PRESS

FIELD OF THE INVENTION

The present invention is directed generally to a collect-printing unit for security printing in dry-offset printing for use in a rotary printing press. More particularly, the present invention is directed to a collect-printing unit for security printing having a plurality of sectorially cut-out rollers. Most specifically, the present invention is directed to a collect-printing unit for security printing in dry-offset printing having a forme cylinder which carries letterpress printing formes. The forme cylinder which carries the letterpress printing formes receives a plurality of colors of ink via at least two ink transfer rollers. The printing formes transfer the inks to a first blanket cylinder which, in turn, delivers the inks to the support or work being printed. The various colors of ink are individually supplied by ink cut-out plates to a second blanket cylinder which collects the various inks and delivers them to the ink transfer rollers. The collect-printing unit in accordance with the present invention thus permits the printing of safety backgrounds on security papers and the like in an accurate, efficient manner.

DESCRIPTION OF THE PRIOR ART

Collect-printing rotary printing presses for dry-offset printing are generally known in the art. In such presses, a plurality of forme cylinders which each carry one or more letterpress printing plates are disposed around the periphery of a blanket cylinder. Each of these letterpress printing plates supplies one color of ink to the blanket cylinder to produce the multi-color ink film on the blanket cylinder; this multi-color film then being transferred from the blanket cylinder to the work being printed. Collect-printing rotary printing presses of this type are difficult to maintain in proper registry since all of the letterpress printing plates on the various forme cylinders must be accurately controlled to prevent register displacement which results in squeezed margins and inexact ink coverages.

An example of prior art devices which use a plurality of cut-out elastic cylinders may be seen in U.S. Pat. No. 3,390,631.

SUMMARY OF THE INVENTION

It is an object of the present invention to provide a printing unit for dry-offset collect-printing from letterpress printing formes or plates, for use in a rotary printing press, which is suitable for printing one, or a plurality of lines in multi-color printing as a safety background on security papers, and which permits printing these lines with continuous color change free from register displacement. The cut-out cylinders do not have a soft surface, and the letterpress frame is to be inked at least twice.

It is a further object of the present invention to provide a printing unit for dry-offset collect-printing from letterpress printing formes in which lines or areas can be printed in continuous color change without any register displacement.

Another object of the present invention is to provide a collect-printing unit in which there is no necessity of providing an ink collecting cylinder which collects the different color inks before transferring them onto the hard letterpress printing forme.

The collect printing unit in accordance with the present invention does not require the provision of a plurality of forme cylinders with letterpress printing formes fixed on them for printing a background of multi-color security lines. Thus, laborous adjustment and precise registering of the individual letterpress printing formes to each other is not necessary. It is possible to utilize letterpress printing plates which permit the obtaining of a printed image of a quality which may be put in the same category with dry-offset printing. The width of the lines on the printing forme is maintained when the lines are transferred onto the support to be printed. The external contours of the lines and print areas are sharply marked-off and present a uniform ink coverage. There are no "squeezed margins", which cannot be avoided in dry-offset printing from a hard forme onto a support to be printed, and no inexact ink coverages.

Hard, durable ink contour plates made, for example, of plastic material having a high degree of durability and long life can be used for sectorial inking by securing the hard ink contour plates to the plurality of cut-out rollers. In contrast to soft ink contour plates, the production of ink contour plates with exact register is thus very simple. The production of these soft rubber ink contour plates which have been used in this type of collect printing is very expensive yet still results in inexact register precision. The use of hard ink contour plates permits the inking of even the smallest detached color areas in a field which has been inked in a different color since these small detached color fields which are produced by the hard ink contour plates do not shift when they contact the hard printing forme as is apt to happen when the soft rubber ink contour plates are used.

The collect-printing unit in accordance with the present invention facilitates the high quality printing of multiple colors on security papers and the like in a manner which is much less difficult and which produces much higher quality results than has been possible with prior art devices.

BRIEF DESCRIPTION OF THE DRAWING

While the novel features of the collect-printing unit for security printing for use in a rotary printing press in accordance with the present invention are set forth with particularity in the appended claims, a full and complete understanding of the invention may be had by referring to the description of a preferred embodiment as set forth hereinafter and as may be seen in the accompanying drawing, which is:

a schematic side view of a collect-printing rotary printing press provided with a printing unit in accordance with the present invention.

DESCRIPTION OF THE PREFERRED EMBODIMENT

Referring to the sole drawing FIGURE, there may be seen a preferred embodiment of the collect-printing unit for security printing for use in a rotary printing press in accordance with the present invention. While the printing unit in accordance with the present invention will hereinafter be described primarily with reference to a sheet-fed rotary printing press, it will be understood that the printing unit could also be used with a web-fed rotary printing press.

In the preferred embodiment, sheets or supports 2 to be printed arrive from a sheet feeder 1 in a manner known in the art such as, for example, by means of conveyor tapes (not shown) over a stop drum 3, and transfer drums 4 to a counter-pressure cylinder 6. The stop drum 3, transfer drums 4, and counter-pressure cylinder 6 are provided, in the sheet-fed rotary printing press, with controlled sheet grippers as is known in the art. The counter-pressure cylinder 6 may not carry a rubber blanket around its periphery, and may therefore be a hard counter-pressure cylinder.

A first, small blanket cylinder 8 cooperates under pressure with the counter-pressure cylinder 6. The support to be printed, for example a sheet 2, is printed by being interposed between the counter-pressure cylinder 6 and the first blanket cylinder 8. The first blanket cylinder 8 carries a blanket 7 around its periphery which blanket 7 is inked sectorially in different colors by a letterpress printing forme or plate fixed on a forme or plate cylinder 9. In other words, the forme cylinder 9 carries a hard letterpress press printing forme around its periphery, which corresponds to the motif to be printed. The letterpress printing forme, or a plurality of such formes which are fixed on the forme cylinder 9 are sectorially inked in different colors by a sectorial ink coating on a blanket of a first ink transfer cylinder 11. The blanket of the first ink transfer cylinder 11 receives its sectorial multi-color ink coating from a blanket or a hard cover, for example of Nyloprint, on a second ink transfer cylinder 13. This blanket or this hard cover on second ink transfer cylinder 13 receives ink coatings from a blanket 10 of a second, large blanket cylinder 12. The blanket 10 of this second blanket cylinder 12 is inked by plural ink contour plates 19, 21, 22 and 23; which are fixed on cut-out rollers 14, 16, 17 and 18; respectively.

As may be seen in the drawing, the plurality of cut-out rollers 14, 16, 17 and 18 are spaced about half the circumference of the second blanket cylinder 12. One hard, cut-out ink contour plate 19, 21, 22 and 23 is disposed on the periphery of each cut-out roller. Each of the ink contour plates, which has ink-absorbing elevations extending essentially in sectors, is inked by an inking unit 24, 26, 27 and 28 coordinated to it. These ink contour plates can be metal plates or hard plastic plates made, for example, of Nyloprint.

The cut-out rollers 14, 16, 17 and 18 have the same peripheries or diameters as the second ink transfer cylinder 13, the first ink transfer cylinder 11, the forme cylinder 9, and the first blanket cylinder 8. The diameter of the second blanket cylinder 12 may be a multiple of the diameter of each of the above mentioned cylinders and rollers, for example triple the diameter, as is shown in the preferred embodiment. The counter-pressure cylinder 6 can have the same diameter as the second blanket cylinder 12; it can, on the other hand, also have the same diameter as the first blanket cylinder 8.

If, as is shown in the preferred embodiment in accordance with the present invention, the second blanket cylinder 12 has a diameter triple that of the diameter of the second ink transfer cylinder 13, the first ink transfer cylinder 11, and the forme cylinder 9, an angle $\alpha$ of 42.94° is formed by straight lines 31 and 32 which intersect at the center of rotation 29 of the second blanket cylinder 12. Line 31 lies on the axis of rotation 33 of the second ink transfer cylinder 13, and the axis of rotation 34 of the plate cylinder 9 lies on the straight line 32. This causes, in accordance with the present invention, an inking of the letterpress printing forme or plate fixed on the forme or plate cylinder 9 which, in the preferred embodiment is a double inking, that is staggered for the length of a forme cylinder periphery, while still being in precise registry.

In accordance with the present invention, due regard is paid to the necessity, if other relations between the cylinder and roller diameters are preferred, that the letterpress printing forme is inked at least twice before transferring its ink coating onto the support to be printed.

All the cylinders, drums and rollers are synchronously driven in a manner known in the art from a main motor 36 through a common train of gear drives which are not specifically shown in the drawing but which will be understood to be conventional and well known in the art.

It will be understood that the collect-printing unit in accordance with the present invention could be adapted for simultaneous recto and verso printing. Such a modification, while not shown in the drawing, would include the omission of the counter-pressure cylinder 6 and the substitution of an additional third blanket cylinder 8 which would be placed as the mirror-image of the first blanket cylinder 8. This third blanket cylinder would have coordinated to it a second forme cylinder, a third ink transfer cylinder, a fourth ink transfer cylinder and a fourth blanket cylinder, which would be inked by a plurality of cut-out rollers by means of hard ink contour plates which are supplied by suitable inking units. Thus recto and verso printing could be accomplished simultaneously by putting two of the collect printing units in accordance with the present invention together as mirror images of each other with the omission of the counter-pressure cylinder 6. The material to be printed would then be fed between the two cooperating first blanket cylinders 8.

Collect-printing units for security printing which are generally similar to the subject invention are set forth in applicant's German Patent Application Nos. P3109963.7, filed in Germany on Mar. 14, 1981; P3113055.0, filed in Germany on Apr. 1, 1981; and P3113407.6, filed in Germany on Apr. 4, 1981; and in German Patent Application No. P31009977.7 of Germann and Ruckmann, filed in Germany on Mar. 14, 1981; and their corresponding United States patent application filed on even date with the subject application and assigned to a common assignee.

It will be understood that the sheets 2 to be printed are fed to the collect-printing unit by a sheet conveyor system which takes them from a stack and delivers them to the unit in a conventional manner. If the collect-printing unit in accordance with the present invention were being used with a web of paper it will be understood that this web, after being printed, could be conveyed to, for example, a sheeter which cuts the web into sheets and transfers them to a pile delivery.

While a collect-printing unit for security printing in a rotary printing press in accordance with the present invention has been fully and completely described, it will be obvious to one of ordinary skill in the art that a number of changes in, for example, the sheet delivery means, the specific drive means, the number of cut-out plates, rollers and associated inking units and the like could be made without departing from the true spirit and scope of the invention and that the invention is, accordingly to be limited only by the following claims:

I claim:

1. A collect-printing unit for the indirect security printing in dry-offset of a complete multi-color ink coating for use in printing on supports such as sheets and webs in a rotary printing press, said collect-printing unit comprising:

a plate cylinder having at least one letterpress printing plate affixed to the periphery of said plate cylinder;

a first blanket cylinder contacting said plate cylinder;

a second blanket cylinder contacting said plate cylinder and having a plurality of ink receiving blankets affixed to the periphery of said second blanket cylinder;

a plurality of sectorially cut-out rollers, each of said cut-out rollers having at least one hard cut-out ink contour plate affixed thereto, each of said ink contour plates, receiving one color of said multi-color ink coating, each of said cut-out rollers further having an inking unit coordinated thereto to supply said one color of said multi-color ink coating to said at least one ink contour plate affixed thereto, each of said plurality of cut-out rollers being in contact with each of said ink receiving blankets on said second blanket cylinder to impart said complete multi-color ink coating to each of said ink receiving blankets on said second blanket cylinder;

a first ink transfer cylinder contacting said plate cylinder, and a second ink transfer cylinder contacting both said first ink transfer cylinder and said second blanket cylinder, said plate cylinder receiving a double inking formed as a combination of partial ones of said complete multi-color ink coatings that are imparted to successive ones of said ink receiving blankets on said second blanket cylinder, said partial coatings being transferred in registry to said plate cylinder from both said first ink transfer cylinder and said second blanket cylinder, said plate cylinder transferring said complete multi-color ink coating to said first blanket cylinder; and a counter-pressure cylinder cooperating with said first blanket cylinder so that the support to be printed is printed by being interposed between said first blanket cylinder and said counter-pressure cylinder.

2. The collect-printing unit for use in a rotary printing press in accordance with claim 1, wherein the circumferences of said cut-out rollers, of said first ink transfer cylinder, of said second ink transfer cylinder, of said plate cylinder, and of said first blanket cylinder are of equal length, wherein the circumference of said second blanket cylinder is an integral multiple of the circumference of said plate cylinder, and further wherein said counter-pressure cylinder has a circumference equal to that of said second blanket cylinder.

3. The collect-printing unit for use in a rotary printing press in accordance with claim 1, wherein said second ink transfer cylinder has a soft peripheral surface.

4. The collect-printing unit for use in a rotary printing press in accordance with claims 1 or 2, wherein said second ink transfer cylinder has a hard peripheral surface.

5. The collect-printing unit for use in a rotary printing press in accordance with claim 1, wherein said circumference of said second blanket cylinder compared with said circumferences of said cut-out rollers, said first ink transfer cylinder, and said first blanket cylinder, is in the ratio of 3 to 1.

6. The collect-printing unit for use in a rotary printing press in accordance with claim 1, wherein said second blanket cylinder carries a soft, printing ink transferring cover, such as an offset printing blanket.

7. The collect-printing units for use in a rotary printing press in accordance with claim 1, wherein said first blanket cylinder carries a soft, printing ink transferring cover, such as an offset printing blanket.

8. The collect-printing unit for use in a rotary printing press in accordance with claim 1, wherein said counter-pressure cylinder is a hard cylinder.

9. The collect-printing unit for use in a rotary printing press in accordance with claim 1, wherein said counter-pressure cylinder is covered with an offset printing blanket.

10. The collect-printing unit for use in a rotary printing press in accordance with claim 1, further wherein a second printing unit comprising a third blanket cylinder, a second plate cylinder, a third ink transfer cylinder, a fourth ink transfer cylinder, and a plurality of second cut-out rollers; each with one cooperating inking unit; are coordinated to said counter-pressure cylinder.

11. The collect-printing unit for use in a rotary printing press in accordance with claim 10, wherein hard ink contour plates are secured to said second cut-out rollers.

12. The collect-printing unit for use in a rotary printing press in accordance with claim 1, wherein said second ink transfer cylinder and said plate cylinder are disposed at an angle $\alpha$ of 42.94°, said angle $\alpha$ being defined as the angle between first and second lines which extend radially outwardly from the axis of rotation of said second blanket cylinder, said first line passing through the axis of rotation of said plate cylinder and said second line passing through the axis of rotation of said second ink transfer cylinder.

* * * * *